US006866562B2

(12) United States Patent
Girolamo

(10) Patent No.: US 6,866,562 B2
(45) Date of Patent: Mar. 15, 2005

(54) FINISHING OF METAL SURFACES AND RELATED APPLICATIONS

(75) Inventor: Mario Girolamo, Burwood (AU)

(73) Assignee: Megara (Australia) PTY LTD, Victoria (AU)

( * ) Notice: Subject to any disclaimer, the term of this patent is extended or adjusted under 35 U.S.C. 154(b) by 0 days.

(21) Appl. No.: 10/344,222

(22) PCT Filed: Aug. 10, 2001

(86) PCT No.: PCT/AU01/00985

§ 371 (c)(1),
(2), (4) Date: Feb. 10, 2003

(87) PCT Pub. No.: WO02/14016

PCT Pub. Date: Feb. 21, 2002

(65) Prior Publication Data

US 2003/0171074 A1 Sep. 11, 2003

(30) Foreign Application Priority Data

Aug. 10, 2000 (AU) ..... PQ 9308

(51) Int. Cl.[7] ..... B32B 7/02

(52) U.S. Cl. ..... 451/38; 451/75; 428/334; 428/500; 264/290.2; 156/229

(58) Field of Search ..... 451/38, 39, 75; 428/334, 409, 461, 500, 516; 264/290.2; 156/229; 361/233

(56) References Cited

U.S. PATENT DOCUMENTS 5,155,604 A * 10/1992 Miekka et al. ..... 359/2
5,252,389 A * 10/1993 Schmidt et al. ..... 428/334
5,654,118 A * 8/1997 Yuh et al. ..... 430/65

* cited by examiner

*Primary Examiner*—Lee D. Wilson
*Assistant Examiner*—Anthony Ojini
(74) *Attorney, Agent, or Firm*—Fulwider Patton Lee & Utecht, LLP

(57) ABSTRACT

A process for finishing a metal surface comprises subjecting the surface to successive grit blasting passes including a first series of successive blasting passes using an abrasive grit of a first diameter range applied with a blasting nozzle air pressure in a first range, and a second series of successive blasting passes using an abrasive grit of a second diameter range smaller than the first diameter range, applied with a blasting nozzle air pressure in a second range lower than the first range. Thereafter a third series of successive blasting passes, using glass grit of a third diameter range smaller than the second diameter range, is applied with a blasting nozzle air pressure in a third range lower than the first range.

31 Claims, 5 Drawing Sheets

100μm

100μm

100μm

100μm

FINISHING OF METAL SURFACES AND RELATED APPLICATIONS

RELATED APPLICATIONS

Figure 1:
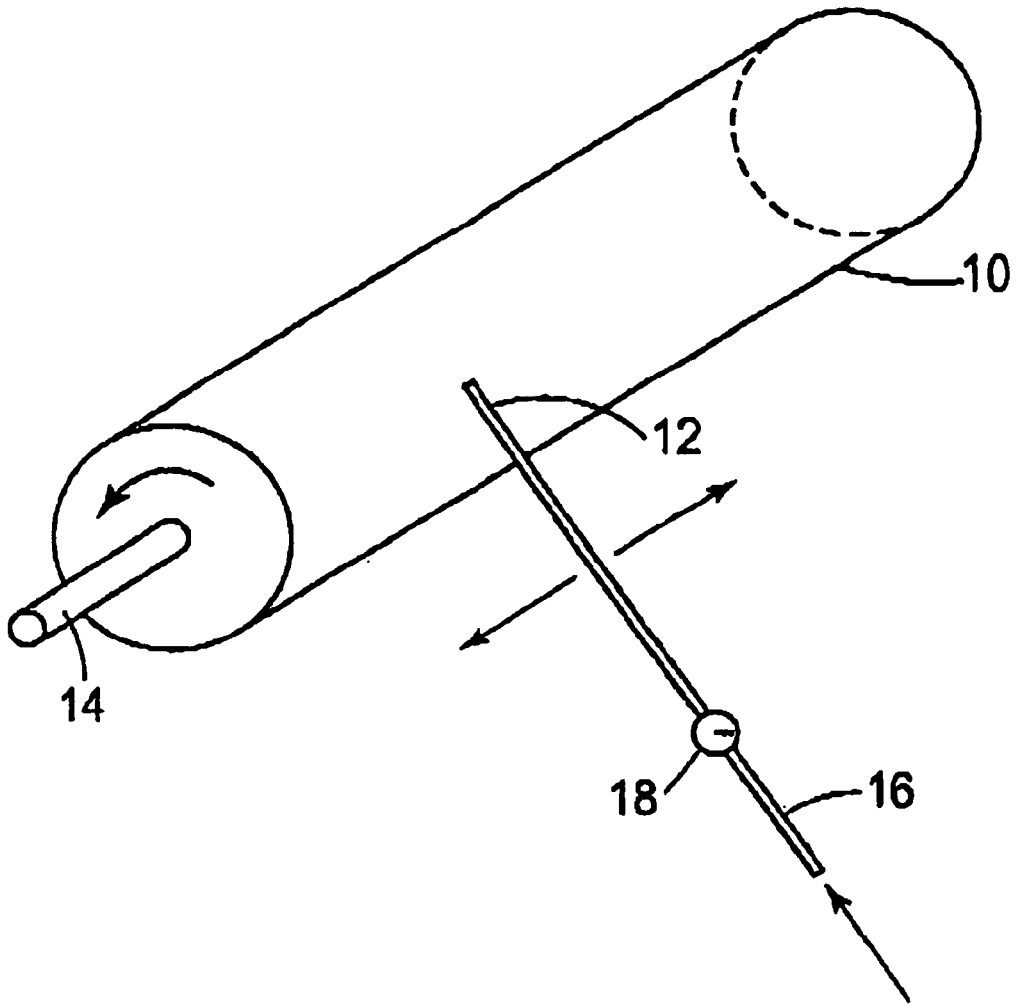

This is a National Phase Application in the United States of America of International Application PCT/AU01/00985 filed 10 Aug. 2001, which claims priority from Australian Patent Application No. PQ 9308 filed 10 Aug. 2000.

FIELD OF THE INVENTION

This invention relates generally to the finishing of metal surfaces and is particularly useful for the preparation of surfaces of metal finishing rolls used, for example, in the embossment of extruded plastic sheet such as polypropylene sheet. The invention will be described with particular reference to the latter application but it is emphasised that the concepts of the invention have much wider application. The invention is also directed to plastics sheet material having related surface characteristics.

BACKGROUND ART

Polypropylene sheet is formed by drawing an extruded curtain melt through opposed dies that are finely adjustable to determine sheet characteristics. The surface patterning of the resulting sheet is determined by a pass over a large stainless steel roll having an appropriate complementary surface finish. The rolls are expensive in the sense that, although replacement for wear is only occasional, they are easily damaged during roll handling or machine adjustment and when damaged, even in a minor way, are inevitably written off.

Polypropylene sheet produced in this way has found a wide variety of applications and a large proportion of these involve printing of the sheet. To optimise offset printing, for example, a high quality finish is desirable which is sufficiently matt to retain the ink and yet has a surface topography that achieves optimal uniformity of ink spread. Magnification of printed surfaces of this kind will often reveal gaps in the ink coverage which arise from interaction between the ink liquid, which has a high surface tension, and fine topographical features of the surface. Such ink gaps may not be readily apparent to the naked eye but nevertheless adversely affect print quality.

A further consideration is that polypropylene accurately replicates surfaces it contacts and thus any imperfections in the finishing roll surface will be faithfully reproduced in the surface of the plastic sheet.

A known method for finishing the surface of stainless steel rolls is by grit blasting with alumina particles at a blasting nozzle air pressure of 60 psi. A first series of passes using alumina grit of a larger size range is followed by a series with grit of a lower size range and then a single pass of the same larger size range. These are all carried out at a uniform blasting nozzle air pressure. The process is completed with a single pass with fine glass beads, of size an order of magnitude lower than the alumina and at an air pressure lower than for the alumina passes.

It is an object of the invention to provide a process for finishing a metal surface in order to achieve optimum uniformity of the surface with finite but minimal height variations.

SUMMARY OF THE INVENTION

It has been realised, in accordance with the invention, that the aforementioned known process can be adapted and substantially improved by a novel regime of grit blasting passes.

The invention accordingly provides, in a first aspect, a process for finishing a metal surface, comprising subjecting the surface to successive grit blasting passes including:

(a) a first series of successive blasting passes using an abrasive grit of a first diameter range applied with a blasting nozzle air pressure in a first range;

(b) a second series of successive blasting passes using an abrasive grit of a second diameter range smaller than said first diameter range, applied with a blasting nozzle air pressure in a second range lower than said first range; and (c) thereafter a third series of successive blasting passes using glass grit of a third diameter range smaller than said second diameter range, applied with a blasting nozzle air pressure in a third range lower than the first.

In a second aspect, the invention is directed to a metal surface treated by a process according to the first aspect of the invention, which surface is preferably characterised by a maximum valley-to-peak height generally less than 5 micron. Preferably, the average valley-to-peak height is about 3 micron. Preferably, the surface of the material is further characterised by a value of less than 0.5 micron for a roughness parameter representing the arithmetic mean of the departure of the roughness profile from the mean line within a sampling length.

In a third aspect, the invention provides a sheet of plastics material finished by contact with a metal, preferably steel, surface, preferably by rolling with a cylindrical surface of a roll, which metal surface is finished by the process according to the first aspect of the invention.

The invention is further directed, in a fourth aspect, to a sheet of polypropylene printing substrate having a surface characterised by a valley-to-peak height generally less than 5 micron, preferably less than 4 micron, and a roughness parameter (as earlier defined) of less than 0.5 micron.

Preferred and Optimal Features of the Invention

The preferred metal surface finished by the process is a roller grade steel suitable for embossing rollers, for example a steel especially applicable to subsequent finishing of extruded plastics sheet.

Advantageously, at least one of, and preferably each of, the series of successive passes consists of three passes, but each has at least two passes.

The abrasive grit may conveniently be a metallic oxide grit such as alumina (aluminium oxide). Other possible grits include but are not limited to silicon dioxide and manganese dioxide. A preferred glass grit consists of spherical glass beads.

After the glass grit blasting step, the surface is preferably chromed or otherwise provided with a protective metal coating, eg. to a thickness in the range 10 to 100 micron. A particularly suitable form of this step is flash chroming to 25 micron thickness.

A simple diagram of a convenient grit blasting configuration is provided in FIG. 1. A blasting nozzle 12 traverses the roll 10 longitudinally as the roll is rotated on a support shaft or mandrel 14. Nozzle 12 is supplied with air-entrained grit via a duct 16 and a restrictor 18 that determines the blasting nozzle head pressure and thereby the aforementioned blasting nozzle air pressure.

The first range of blasting nozzle air pressure is preferably 50 to 70 psi, advantageously around 60 psi. The second range of blasting nozzle air pressure is preferably 30 to 50 psi, most preferably around 40 psi.

Preferably, the second and third ranges of blasting nozzle air pressure are substantially the same.

Although this specification refers to blasting nozzle "air" pressure, the term embraces other gases for particular applications.

It will be understood that, in stating that a range is lower than another range, it is envisaged that the first mentioned range would not necessarily be discrete from the other range but that the two may well overlap. Indeed, overlap is preferred between said first and second diameter ranges. It is intended, however, that the upper limit of the lower range will not exceed the upper limit of the higher range.

The first and second diameter ranges preferably overlap. For example, the first range may be 50–100 micron (150–230 grit), conveniently 180 grit, ie. 63–90 micron (a commercially available range for alumina grit), while the second diameter range may be 40–90 micron (180–320 grit), for example 220 grit, ie. 53–75 micron. The third diameter range may be 30–75 micron, for example 320 grit, ie. 40–50 micron.

Preferably, the third range of grit diameter is distinctly narrower than the other ranges.

The preferred application of a plurality of passes of the glass bead, rather than just one pass as before, is thought to be useful in optimizing the final result. On the one hand, one pass is thought to be insufficient to adequately reduce topographical peaks in the surface profile and to thereby reduce localised gaps in ink layers caused by ink flow off these peaks into valleys resulting from the surface tension of the ink. On the other hand, too many passes will over-smooth the surface: some degree of final roughness, albeit a uniform roughness, is necessary for ink retention.

It is thought that the lowering of the air pressure for the second pass of abrasive grit, which is in contrast to the earlier mentioned practice, is advantageous in reducing or eliminating penetration of the grit particles into the metal surface: it is believed that this has occurred with the previous practice and is of course counterproductive to the simultaneous reduction of topographical peaks by the grit particles.

It is observed that the surface produced by rolling polypropylene sheet with a steel roll having a surface finished in accordance with the invention and thereafter chromed, has a topographical valley-to-peak height variation generally less than 5 micron, preferably less than 4 micron preferably about 3 micron, but does not appear to be highly polished, is not a glossy finish but rather exhibits an illusion of mattness. An advantageous feature of the rolled surface of the polypropylene sheet is the absence of very high peaks in the profile. The maximum profile peak height is preferably less than 2 micron, typically 1 to 1.5 micron. This parameter is especially advantageous for obtaining high quality print characteristics when the surface is printed.

Figure 2:
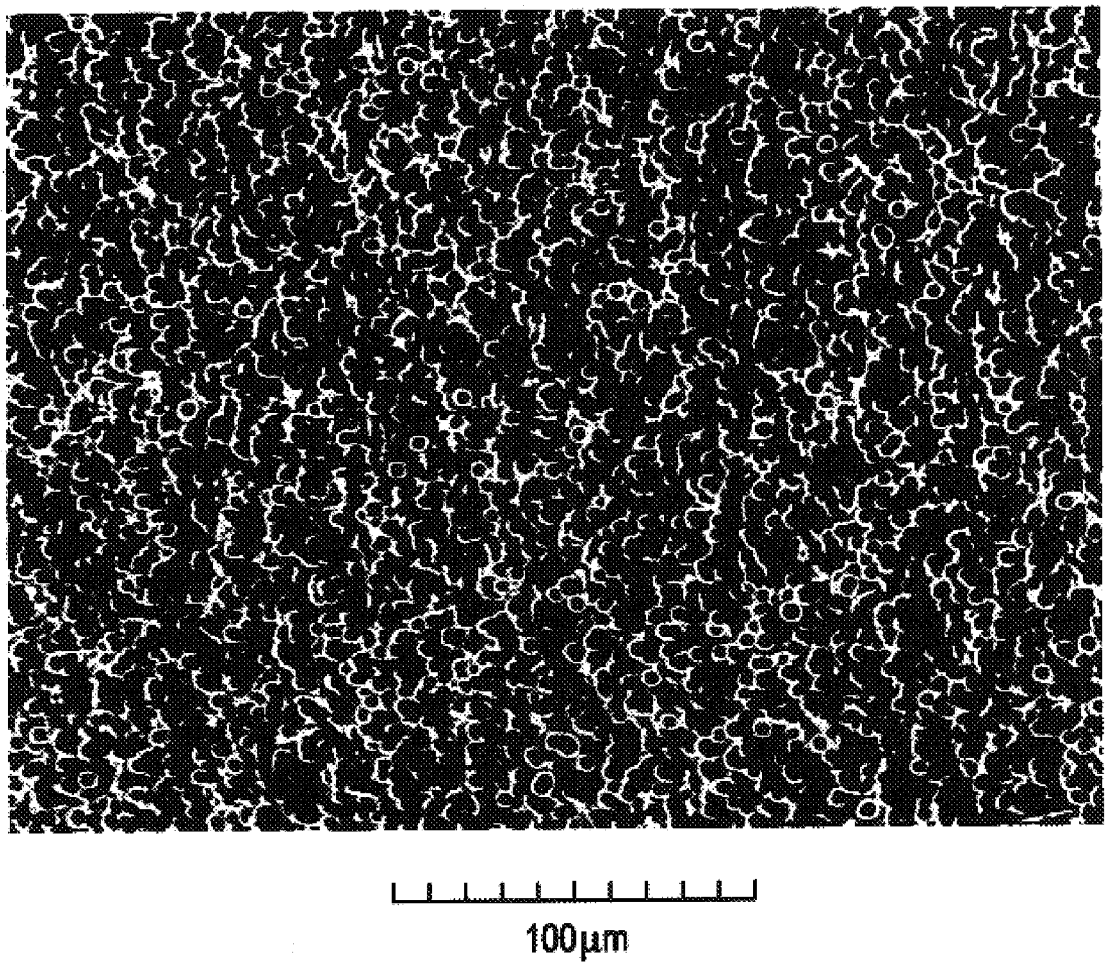
Figure 3:
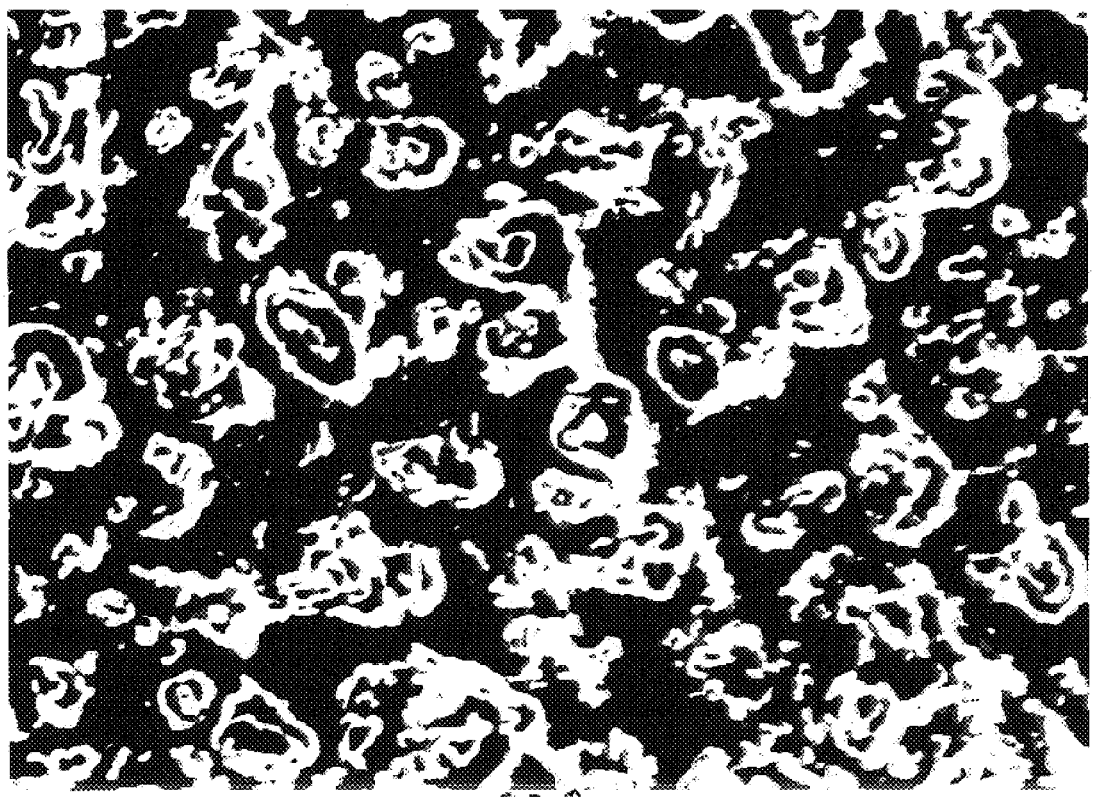
FIG 3 (PRIOR ART)

FIG. 2 is an optical micrograph of an exemplary roll surface finish produced by applying an embodiment of the method of tie invention. FIG. 3 is an optical micrograph, at the same magnification, of a conventional grit blasted roll surface finish. Comparing the two it will be seen that the grain microstructure is relatively much finer in the roll of the invention, of the order of 5 micron or less, and relatively very uniform in its distribution: the conventional grain microstructure is much larger, with less uniformity. The relief microstructure of the conventional surface is of the order of 50–100 microns.

Figure 4:
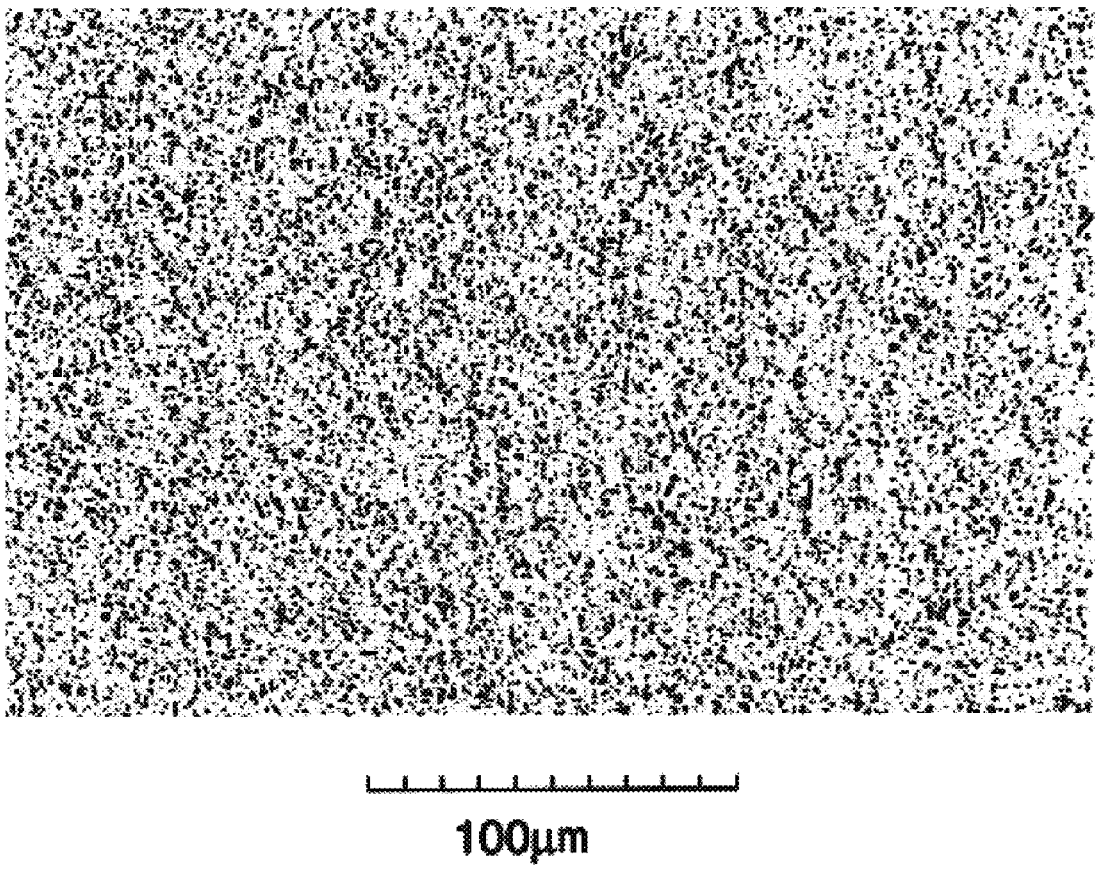
Figure 5:
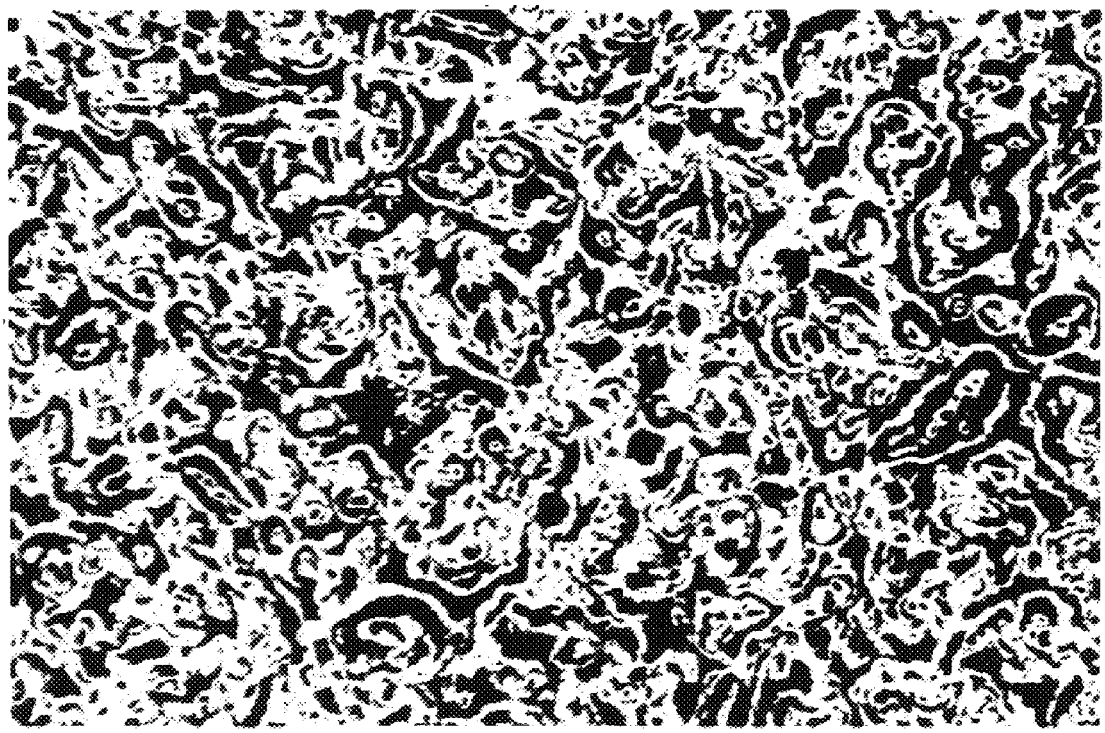
FIG 5 (PRIOR ART)

FIGS. 4 and 5 are corresponding optical micrographs of the surface of polypropylene sheet rolled with the rolls depicted in FIGS. 2 and 3 respectively. Again, these views depict the relatively much finer and more uniform e microstructure of the surface (FIG. 4) that is formed with the roll surface produced by an embodiment of the method of the present invention. Indeed, the aforedefined roughness parameter is about 0.5 micron for the surface of FIG. 4, compared with 3–3.5 micron for the surface of FIG. 5. The average valley-to-peak height is clearly less than 5 micron in the surface of FIG. 4, typically about 3 micron, but about 20 micron for the conventional surface of FIG. 5. The maximum profile peak height was found to be 1.5 micron in the surface of FIG. 4, but 7.5 micron in the conventional surface.

What is claimed is:

1. A process for finishing a metal surface, comprising subjecting the metal surface to successive grit blasting passes including:

(a) a first series of successive blasting passes using an abrasive grit of a first diameter range applied with a blasting nozzle air pressure in a first range;

(b) a second series of successive blasting passes using an abrasive grit of a second diameter range smaller than said first diameter range, applied with a blasting nozzle air pressure in a second range lower than said first range; and (c) thereafter a third series of successive blasting passes using glass grit of a third diameter range smaller than said second diameter range, applied with a blasting nozzle air pressure in a third range lower than said first range.

2. A process according to claim 1 wherein said metal surface is of a roller grade steel suitable for being used for embossing rollers.

3. A process according to claim 2 wherein said steel is suitable for subsequent finishing of extruded plastics sheet.

4. A process according to claim 3 wherein at least one of said first, second and third series of successive blasting passes consists of three passes.

5. A process according to claim 4 wherein each of said first, second and third series of successive blasting passes consists of three passes.

6. A process according to claim 1 wherein at least one of said first, second and third series of successive blasting passes consists of three passes.

7. A process according to claim 6 wherein each of said first, second and third series of successive blasting passes consists of three passes.

8. A process according to claim 1 wherein said abrasive grit is metallic oxide grit.

9. A process according to claim 1 wherein said glass grit consists of spherical glass beads.

10. A process according to claim 1 further including, after said glass grit blasting passes, providing said surface with a protective metal coating.

11. A process according to claim 10 wherein said surface is provided with a protective metal coating by chroming the surface.

12. A process according to claim 10 wherein said protective metal coating is of a thickness in the range of 10 to 100 micron.

13. A process according to claim 1 wherein said first range of blasting nozzle air pressure is 50 to 70 psi.

14. A process according to claim 13 wherein said second range of blasting nozzle air pressure is 30 to 50 psi.

15. A process according to claim 14 wherein said second and third ranges of blasting nozzle air pressure are substantially the same.

16. A process according to claim 1 wherein said second range of blasting nozzle air pressure is 30 to 50 psi.

17. A process according to claim 1 wherein said second and third ranges of blasting nozzle air pressure are substantially the same.

18. A process according to claim 1 wherein said first and second diameter ranges overlap.

19. A process according to claim 18 wherein said third diameter range is distinctly narrower than the other ranges.

20. A process according to claim 1 wherein said third diameter range is distinctly narrower than the other ranges.

21. A metal surface treated by a process according to claim 1.

22. A metal surface according to claim 21 wherein said surface is characterized by a maximum valley-to-peak height generally less than 5 micron.

23. A metal surface according to claim 22 wherein the average valley-to-peak height is about 3 micron.

24. A metal surface according to claim 21 wherein the average valley-to-peak height is about 3 micron.

25. A metal surface according to claim 21 characterized by a value of less than 0.5 micron for a roughness parameter representing an arithmetic mean of the departure of the roughness profile from the mean line within a sampling length.

26. A sheet of plastics material finished by contact with a metal surface, which metal surface is finished by a process according to claim 1.

27. A sheet according to claim 26 wherein said metal surface is a cylindrical surface of a roll, and said contact is by rolling with the cylindrical surface.

28. A sheet of polypropylene for use as a printing substrate, wherein said sheet has a surface characterized by a valley-to-peak height generally less than 5 micron and a roughness parameter of less than 0.5 micron, which parameter represents an arithmetic mean of the departure of the roughness profile from the mean line within a sampling length.

29. A sheet according to claim 28 wherein said surface has a topographical valley-to-peak height variation generally less than 4 micron.

30. A sheet according to claim 29 wherein the maximum profile peak height is in the range 1 to 1.5 micron.

31. A sheet according to claim 29 wherein the maximum profile peak height is less than 2 micron.

* * * * *

UNITED STATES PATENT AND TRADEMARK OFFICE

CERTIFICATE OF CORRECTION

PATENT NO. : 6,866,562 B2
DATED : March 15, 2005
INVENTOR(S) : Mario Girolamo

It is certified that error appears in the above-identified patent and that said Letters Patent is hereby corrected as shown below:

Column 3,
Line 56, delete "tie" and insert -- the --.

Column 4,
Line 1, delete "uniform e" and insert -- uniform --.

Signed and Sealed this

Ninth Day of August, 2005

JON W. DUDAS
*Director of the United States Patent and Trademark Office*